US006136751A

United States Patent [19]

Harada

[11] Patent Number: 6,136,751

[45] Date of Patent: Oct. 24, 2000

[54] REVERSIBLE THERMOSENSITIVE RECORDING MEDIUM, AND IMAGE FORMING AND ERASING METHOD

[75] Inventor: Shigeyuki Harada, Shimizu-machi, Japan

[73] Assignee: Ricoh Company, Ltd., Tokyo, Japan

[21] Appl. No.: 09/238,317

[22] Filed: Jan. 28, 1999

[30] Foreign Application Priority Data

Jan. 29, 1998 [JP] Japan ..... 10-030366

[51] Int. Cl.[7] ..... B41M 5/34

[52] U.S. Cl. ..... 503/201; 503/200; 503/226

[58] Field of Search ..... 503/200, 201, 503/226

[56] References Cited

U.S. PATENT DOCUMENTS 3,912,844 10/1975 Endo et al. ..... 428/500

*Primary Examiner*—Bruce H. Hess
*Attorney, Agent, or Firm*—Cooper & Dunham LLP

[57] ABSTRACT

A reversible thermosensitive composition is provided, comprising a matrix resin and at least one kind of low molecular weight organic material dispersed in the matrix resin, the reversible thermosensitive composition changing transparency reversibly with temperature, in which the matrix resin comprises a graft polymer or a graft copolymer, having the following polymerizing unit, wherein $R^1$ and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen, or —CON($R^5$)—$R^3$—C($R^4$)=($CH_2$), inclusive of hydrogen at the end of a polymer chain. Also disclosed are a reversible thermosensitive recording medium, comprising a supporting substrate and the reversible thermosensitive composition disposed on the supporting substrate.

60 Claims, 1 Drawing Sheet

REVERSIBLE THERMOSENSITIVE RECORDING MEDIUM, AND IMAGE FORMING AND ERASING METHOD

BACKGROUND OF THE INVENTION

1. Field of the Invention

This invention relates to a reversible thermosensitive material which permits repeated formation and erasure of images by utilizing a reversible change in transparency of a thermosensitive layer thereof with temperature.

2. Discussion of Background

A variety of information recording media have been developed to comply with the demands of the expanding and diversifying volume of information. A reversible thermosensitive recording medium has been attracting much attention recently for its capability of forming and erasing images which can be carried out repeatedly on demand. Reversible thermal recording media are known to be capable of forming and erasing images by reversibly changing optical properties between two states, a white opaque state (image formed) and a transparent state (erased), depending on temperature.

As representative examples of this kind of reversible thermosensitive recording materials, there have been disclosed in Japanese Laid-Open Patent Applications (referred to as "JPA", hereinafter) 54-154198 (1979) and 55-154198 (1980), recording materials having a thermosensitive layer whose transparency reversibly changes depending on the temperature and in which a low molecular weight organic material is dispersed in a matrix resin such as polyester, polyvinyl chloride or vinyl chloride-vinyl acetate copolymer.

Such recording materials, however, have the disadvantage that the optical density of recorded images decreases with the repetition of recording and erasing, thereby resulting in a decrease in image contrast by repeated heat applications with a heating element such as, for example, a thermal print head used for carrying out the formation and erasure of the recorded images.

In view of the above problem, JPA-62-154547 (1987) proposes the use of a resin matrix for the recording material, having a selected average degree of polymerization and also a selected repetition unit of the vinyl chloride in the copolymer (in particular, an increased average degree of polymerization), to thereby improve the thermal resistance of the matrix and the durability of the recording materials.

Also, JPA-5-85045(1993) proposes to use a resin matrix for the recording material, which is composed of heat cured hydroxylated vinyl chloride-vinyl acetate copolymer with added isocyanate, to thereby improve the thermal resistance of the matrix and the durability of the recording materials.

Such recording materials, however, have shortcomings in that (1) because of the relatively narrow energy range in which this material can be erased, it is not possible to erase an image completely by heating for a short period of time with a thermal printhead, (2) when a white opaque image is stored for a long time, the erasure characteristics often change so that image erasure under conditions suitable in the early stage of the storage becomes incomplete and (3) the difficulty mentioned just above is found more pronounced with increase in the storage temperature.

In addition, other disadvantages are also realized for known reversible thermosensitive recording media in that (1) portions of the recording layer stick to a heating element such as a thermal printhead, caused by a high friction therebetween and (2) the surface of the recording layer becomes rough, having an approximately periodic feature formed corresponding to the dot density of the thermal printhead, which is caused by the relatively easily deformable nature of the layer and increases with the number of repetitions of heat application, thereby resulting in deterioration of the quality of images formed on the reversible thermosensitive recording medium.

To obviate the above-mentioned problem, several attempts have been made to use an overcoat layer disposed on the recording layer, to thereby reduce the coefficient of friction of the recording medium. Illustrative examples of the overcoat layer are one composed of silicone resin or silicone rubber, disclosed in JPA-62-55650 (1987); another overcoat layer of polysiloxane graft polymer, in JPA-63-221087(1985) ; a heat-resisting lubricant coat of silicone graft polymers as a major ingredient, in JPA-2-86491(1990); an overcoat of polysiloxane-polyurea-polyamide multiblock copolymer, in JPA-8-11439(1996); and an overcoat layer of iminohydantoin copolymer including silicon, in JPA-8-11440(1996).

These overcoat layers, however, have a drawback in that it is difficult, for use in offset printing and gravure printing, to transfer printing ink onto the overcoat layer satisfactorily, and to provide printed images on the layer with satisfactory characteristics such as scratch resistance and anti-peeling property against an adhesive tape.

In addition, the above-mentioned overcoat layer of JPA-62-55650 is found to have the drawback of an unsatisfactory adhesive property between it and the underlying recording layer, resulting in peeling caused by repeated application of mechanical stress during the imaging processes and thereby in reduced quality of recorded images. To improve this adhesive property, JPA-1-133781 (1989) discloses a layered structure for the recording medium, in which an intermediate layer composed primarily of resin is formed on a reversible thermosensitive recording layer, and an overcoat layer of heat-resistant resin is formed on the intermediate layer. By this expedient, the adhesive property is found improved by the intermediate layer and the deformation of the surface of the recording media is reduced by the overcoat layer.

In this case, however, there still remain disadvantages such as scratches on the recording layer and removal of portions of the overcoat layer which then stick to heating elements of the thermal printhead, caused by repeated application of mechanical stress during imaging processes. With the increase in accumulation of these portions on the heating elements, the heat conduction from the heating elements to the recording media is hindered, thereby resulting in difficulty in forming satisfactory images.

SUMMARY OF THE INVENTION

It is, therefore, an object of the present invention to provide a novel reversible thermosensitive recording material, which overcomes the above-noted difficulties.

Another object of this invention is to provide a reversible thermosensitive recording medium capable of satisfactorily carrying out the erasure of recorded images with a heating device such as, for example, a thermal printhead, by overcoming difficulties such as (1) the reduction of erasability after storage of recorded white opaque images for a long time and/or at elevated storage temperatures, (2) the deterioration of image quality after repeated imaging processes, caused by portions of the recording layer becoming adhered to a heating element and by a rough feature of the surface of the recording layer, having an approximately periodic feature corresponding to the dot density of the thermal printhead and (3) an insufficient transfer capability of printing ink onto an overcoat layer for use in offset printing and gravure printing, to thereby achieve a sufficient contrast of recorded images and ink transfer capability of reversible thermosensitive recording media.

To achieve the foregoing and other objects, and to overcome the shortcomings discussed above, the invention in a first aspect provides a reversible thermosensitive composition, comprising a matrix resin and at least one kind of low molecular weight organic material dispersed in the matrix resin, in which the reversible thermosensitive composition changes transparency reversibly with temperature, and the matrix resin comprises a graft polymer or a graft copolymer, having a polymerizing unit of the formula (I), (I)

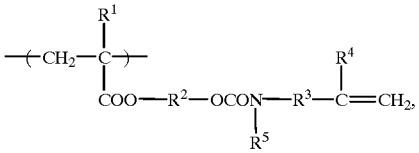

wherein $R^4$and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen, or —CON($R^5$)—$R^3$—C($R^4$)═($CH_2$), inclusive of hydrogen at the end of a polymer chain.

The meaning of the definition of $R^5$ given above, and in all formulas hereinbelow set forth, may be explained by the following illustrations: if $R^5$ is H, then formula (I) is

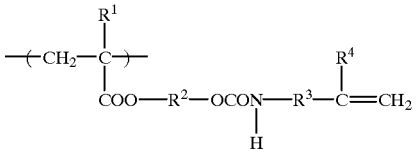

If $R^5$ is —CON($R^5$)—$R^3$—C($R^4$)═($CH_2$), then formula (I) is

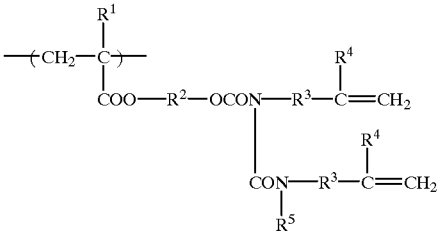

wherein, again, $R^5$ can be H or —CON($R^5$)—$R^3$—C($R^4$)═($CH_2$). $R^5$ can repeatedly be —CON($R^5$)—$R^3$—C($R^4$)═($CH_2$), any number of times without limit, provided that the last iteration of $R^5$ is H; e.g.,

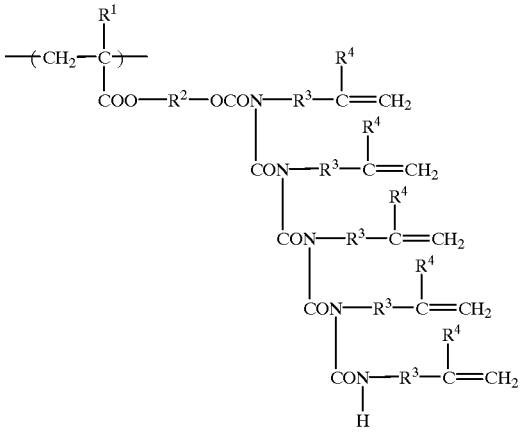

According to an alternate embodiment, another reversible thermosensitive composition is provided, comprising a matrix resin and at least one kind of low molecular weight organic material dispersed in the matrix resin, in which the reversible thermosensitive composition changes transparency reversibly with temperature, and the matrix resin comprises a graft polymer or a graft copolymer, having a polymerizing unit of the formula (II), (II)

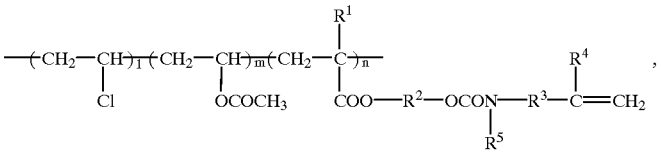

wherein $R^1$ and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen or —CON($R^5$)—$R^3$—C($R^4$)═($CH_2$), inclusive of hydrogen at the end of a polymer chain; l, m and n each is an integer of at least one, that is selected such that the number average molecular weight of the copolymer is at least 1000.

In another embodiment, a reversible thermosensitive recording medium is provided, comprising a supporting substrate and a reversible thermosensitive recording layer disposed at least in a portion of the supporting substrate and including, as main ingredients, a matrix resin and a low molecular weight organic material dispersed in the matrix resin, the reversible thermosensitive recording layer changing transparency reversibly with temperature, in which the matrix resin comprises a graft polymer or a graft copolymer, having a plurality of polymerizing units of the formulae (I) and (II):

(I)

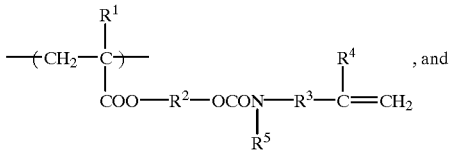

, and (II)

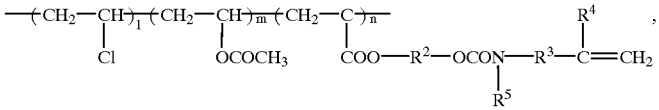

, wherein $R^1$ and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen, or —CON($R^5$)—$R^3$—C($R^4$)═($CH_2$), inclusive of hydrogen at the end of a polymer chain; l, m and n each is an integer of at least one, that is selected such that the number average molecular weight of the copolymer is at least 1000.

In yet another embodiment, another reversible thermosensitive recording medium is provided in a similar manner as described just above, with the exception that the matrix resin comprises a cross-linked polymer prepared by cross-linking a graft polymer or a graft copolymer, by heating, by irradiation with an electron beam or by irradiation with an ultraviolet ray, the graft polymer or graft copolymer having a plurality of polymerizing units of the formulae (I) and (II).

In another embodiment, an overcoat layer is provided on the reversible thermosensitive recording layer, which overcoat layer has a rough surface with a number and height of protruded portions of at least 3 and at least 0.05 μm, respectively, for each surface area of 125 μm×125 μm, and has a pencil hardness of at least 1H.

In another embodiment, an information recording section is further provided, including either a magnetic layer, IC memories or optical memories.

In a further aspect, the invention provides a method of forming and erasing an image on a reversible thermosensitive recording medium, in which both the formation of a white opaque image and the erasure of the white opaque image are carried out by heating means such as either a thermal printhead, a ceramic heater, a hot stamp, a heat roller or a heat block.

BRIEF DESCRIPTION OF THE DRAWING

Preferred embodiments of the invention are described herein-below with reference to the drawing wherein.

DESCRIPTION OF THE PREFERRED EMBODIMENTS

Figure 1:
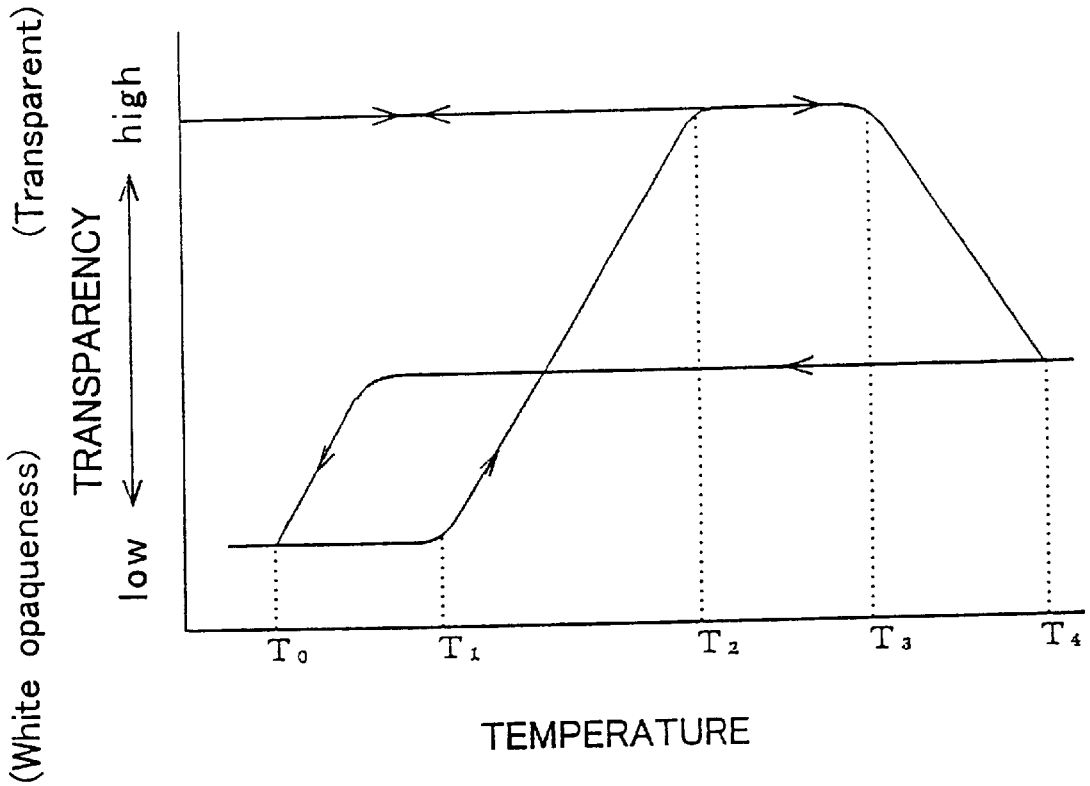
FIG. 1 is a diagram showing the temperature dependence of transparency on the temperature of a thermosensitive recording layer disclosed herein.

In the detailed description which follows, specific embodiments useful in image recording applications are described. It is to be understood, however, that the present disclosure is not limited to these embodiments. For example, it will be appreciated that the recording media and methods therefor disclosed herein are also adaptable to any form of reversible recording media. Other embodiments will be apparent to those skilled in the art upon reading the following description.

One type of reversible thermosensitive composition in accordance with the invention comprises a matrix resin and at least one kind of low molecular weight organic material dispersed in the matrix resin, so that the reversible thermosensitive composition changes transparency reversibly with temperature. The matrix resin in the thermosensitive composition comprises a graft polymer or a graft copolymer, having a polymerizing unit of the formula (I), (I)

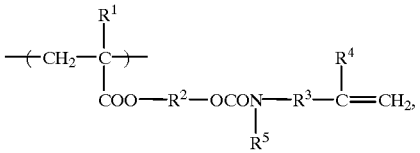

wherein $R^1$ and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen, or —CON($R^5$)—$R^3$—C($R^4$)═($CH_2$), inclusive of hydrogen at the end of a polymer chain.

The matrix resin prepared from the polymerizing unit of the formula (I) mentioned above has excellent properties such as solubility and dispersibility against organic solvents, which relieves the limitation on the selection of the kind of solvents used during the fabrication processes. Also, an excellent white opaque or transparent state of the low molecular weight organic material becomes feasible with this matrix resin, due to its excellent dispersibility for the organic material.

Utilizing an unsaturated bond at the end portion of the polymerizing unit, the unit (I) may take part in cross-linking reactions either with another unit (I) or with another group having an unsaturated bond. The cross-linking reactions may be carried out by heating, ultraviolet irradiation or electron beam irradiation, and efficiently carried out by adding a cross-linking agent. In addition, the cross-linking process by heating is preferred from the consideration of the process cost as well as the excellent display quality of the white opaque and transparent states of the recording media.

Another reversible thermosensitive recording medium is provided in a similar manner to that described just above, with the exception that the matrix resin comprises a graft polymer or a graft copolymer, having a polymerizing unit of the formula (II), (II)

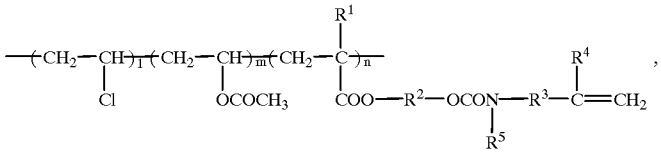

wherein $R^1$ and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen, or $—CON(R^5)—R^3—C(R^4)=(CH_2)$, inclusive of hydrogen at the end of a polymer chain; l, m and n each is an integer of at least one, that is selected such that the number average molecular weight of the copolymer is at least 1000.

The matrix resin prepared from the polymerizing unit of the formula (II) mentioned above has excellent properties such as solubility and dispersibility against organic solvents, which relieves the limitation on the selection of the kind of the solvents used during the fabrication processes. Also, an excellent white opaque or transparent state of the low molecular weight organic material becomes feasible with this matrix resin, due to its excellent dispersibility for the organic material.

It may be noted that the main chain of this graft copolymer has a thermoplastic property. utilizing an acrylic group or a methacrylic group at the end portion of the side chain of the unit, the polymerizing unit (II) may take part in cross-linking reactions. The cross-linking process by heating is preferred from the consideration of the process cost as well as the excellent display quality of the white opaque or transparent state of the recording media. The cross-linking reactions may be carried out efficiently by adding an appropriate cross-linking initiator, when relevant.

The compositional unit which participates in the aforementioned graft polymerization with the polymerizing unit (I) includes, but is not limited to, ethylene, propylene, styrene, vinyl chloride, vinylidene chloride, vinyl alcohol, acrylic acid, acrylic ester, methacrylic acid, methacrylic ester, vinyl acetate, polyamide, polyester, polyaramid, polyacrylate, polyacetal, fluorine polymer, polyurethane, and epoxy resin.

For use in the matrix resin disclosed herein, there may be selected among thermoplastic resins, thermosetting resins, ultraviolet hardening monomers and oligomers, and electron beam hardening monomers and oligomers, which may be appropriately used in combination with the graft polymers.

Specific examples of the thermoplastic resins include polyethylene, polypropylene, polystyrene, polyvinyl chloride, polyvinylidene chloride, polyvinyl alcohol, ethylene-vinyl alcohol copolymers, polyacrylonitrile resin, polymethacrylic acid resin, polymethacrylic ester resin, diene resin, polyamide, polyester, polycarbonate, polyacetal, fluorine resin, polyurethane resin, thermoelastic polystyrene elastomers, thermoelastic polyolefin elastomers, thermoelastic polyurethane elastomers, thermoelastic polyester elastomers, polyphenyl ether, polyphenylene sulfide, polyether sulfone, polyether ketone, polyarylate, aramid, polyimide, poly-p-phenylene, poly-p-xylene, poly-p-phenylene vinylene, poly hydantoin, polyparabanic acid, polybenzoimidazole, polybenzothiazole, polybenzoxadiazole, and polyquinoxaline.

Illustrative examples of the thermosetting resins include phenol resin, urea resin, melamine resin, alkyd resin, acrylic resin, unsaturated polyester resin, diallyl phthalate resin, epoxy resin, silicone resin, furan resin, ketone resin, xylene resin, thermosetting polyimide, stearylpyridine resin, cyanate resin, hardening polyquinoxaline resin, and hardening polyquinoline resin.

Examples of the ultraviolet or electron beam hardening monomers include monofunctional monomers such as 2-hydroxyethyl acrylate, 2-hydroxypropyl acrylate, 2-ethylhexyl acrylate, and 2-hydroxyethyl acryloyl phosphate; bifunctional monomers such as 1,3-butanediol acrylate, 1,4-butanediol acrylate, 1,6-hexanediol diacrylate, diethylene glycol diacrylate, tripropylene glycol diacrylate, neopentyl glycol diacrylate, polyethylene glycol diacrylate, and hydroxypivalic ester neopentyl glycol diacrylate; polyfunctional monomers such as dipentaerythritol triacrylate, pentaerythritol triacrylate, and trimethylolpropane triacrylate.

Specific examples of the ultraviolet or electron beam hardening oligomers include polyester acrylate, epoxy acrylate, polyurethane acrylate, polyether acrylate, polyester acrylate, silicone acrylate, alkyd acrylate, and melamine acrylate.

Examples of useful low molecular weight organic materials include, but are not limited to, alkanols, alkane dioles, halogenated alkanols, halogenated alkane diols, alkylamines, alkanes, alkenes, alkynes, halogenated alkanes, halogenated alkenes, halogenated alkynes, cycloalkanes, cycloalkenes, cycloalkynes, saturated or unsaturated mono or dicarboxylic acids or esters, amides or salts thereof; saturated or unsaturated halogenated fatty acids, or esters, amides or salts thereof; allylcarboxylic acids or esters, amides or salts thereof; halogenated arylcarboxylic acids or esters, amides or salts thereof; thioalcohols; thiocarboxylic acids or esters, amides or salts thereof; and carboxylic acid esters of thioalcohol.

These compounds have from 10 to 60 carbon atoms, preferably from 10 to 38, more preferably from 10 to 30. The alcohol group of the ester may be saturated or unsaturated, or may be substituted with a halogen.

It is preferred that the low molecular weight organic material has a group including at least one of oxygen, nitrogen, sulfur and halogen in its molecule, such as —OH, —COOH, —CONH, —COOR, —NH, —$NH_2$, —S—, —S—S—, —O—, or halogen.

Specific examples of these compounds includes lauric acid (n-dodecanoic acid), myristic acid (n-tetradecanoic acid), n-pentadecanoic acid, palmitic acid (n-hexadecanoic acid), stearic acid (n-octadecanoic acid), n-nanodecanoic acid, arachidic acid (n-eicosanoic acid), n-heneicosanoic acid, behenic acid (n-docosanoic acid), n-tricosanoic acid, lignoceric acid (n-tetracosanoic acid), n-pentacosanoic acid, cerotic acid (n-hexacosanoic acid), n-heptacosanoic acid, montanic acid (n-octanoic acid), melissic acid (n-triacontanoic acid), oleic acid, methyl stearate, dodecyl stearate, octadecyl stearate, octadecyl laurate, tatradecyl palmitate, dodecyl behenate, di-n-hexadecylether, di-n-octadecylether, di-n-dodecylsulfide, di-n-hexadecylsulfide, di-n-octadecylsulfide, diethylene glycol dilaurate, and diethylene glycol distearate.

Examples of useful cross-linking initiators include, but are not limited to, 2,2'-azobis(isobutylnitrile), benzophenone, benzoyl methylbenzoate, diethoxy acetophenone, 2-hydroxy-2-methyl-1-phenylpropane-1-on, 1-hydroxy cyclohexyl phenylketone, 2-methyl-1-(4-methylthio)phenyl-2-) morpholino-propane-1, benzoin isobutyl ether, benzoin propyl ether, benzoin ethyl ether, benzyl dimethylketal, 2-chlorothioxanthone, 2,4-diethylthioxanthone, methyl ethyl ketone peroxide, cumene hydroperoxide, dicumylperoxide, 2,5-dimethyl-2,5-bis (tert-butyl peroxy) hexane, tert-butyl cumylperoxide, di-tert-butyl peroxide, 1,1'-bis(tert-hexylperoxy) 3,3,5-triethylcyclohexane, 1,1'-bis (tert-hexylperoxy) cyclohexane, 1,1'-bis(tert-butylperoxy) 3,3,5-trimethylcyclohexane, 1,1'-bis(tert-butylperoxy) cyclohexane, 2,2'-bis(tert-butylperoxy) butane, 2,2'-bis(tert-butylperoxy) cyclodecane, tert-hexylperoxy isopropyl monocarbonate, tert-butylperoxy maleic acid, tert-butylperoxy-3,3,5-trimethylhexanoate, tert-butylperoxy laurate, 2,5-dimethyl-2,5-bis (m-toluoylperoxy) hexane, tert-butylperoxy isopropyl monocarbonate, tert-butylperoxy-2-ethylhexyl monocarbonate, tert-hexylperoxy benzoate, 2,5-dimethyl-2,5-bis (benzoinperoxy) hexane, tert-butylperoxy diacetate, tert-butylperoxy-m-toluoylbenzoate, tert-butylperoxy benzoate, and bis(tert-butylperoxy) isophthalate.

The reversible thermosensitive recording medium disclosed herein is generally prepared by disposing, onto a supporting substrate, (a) a solution in which the two ingredients of the graft polymer matrix resin and the low molecular weight organic material have been dissolved, (b) a dispersion in which the organic materials in the form of fine particles have been dispersed in a solution of the matrix resin or (c) a dispersion in a solvent, in which neither the organic materials nor the matrix resin are dissolved. These solutions or dispersions are each disposed onto the substrate, then dried to thereby provide a thermosensitive recording layer of a laminate.

Examples of useful solvents include, but are not limited to, alcohols such as methanol, ethanol, n-propanol, isopropanol, n-butanol, sec-butanol, n-octanol, ethylene glycol, diethylene glycol, and benzyl alcohol; esters such as methyl acetate, isopropyl acetate, and n-butyl acetate; cellosolves such as methyl cellosolve, ethyl cellosolve, and butyl cellosolve; ketones such as acetone, methyl ethyl ketone, methyl isobutyl ketone, di-isobutyl ketone, cyclohexanone, and isophorone; amides such as N,N-dimethyl formamide, N,N-dimethyl acetoamide, and N-methyl-2-pyrolidone; ethers such as ethyl ether, dioxane, and tetrahydrofuran; aromatics such as benzene, toluene, xylene and pyridene; hydrocarbons such as n-hexane, cyclohexane and naphtha; hydrocarbon chlorides such as methylene chlorides, ethylene chlorides, propylene chlorides, chloroform, and carbon tetrachloride; water, acetic acid and dimethyl sulfoxide.

The reversible thermosensitive recording medium using a cross-linked matrix resin material disclosed herein is prepared by disposing, on a supporting substrate, (a) a solution in which the two ingredients of the graft polymer or copolymer matrix resin and the low molecular weight organic material have been dissolved, (b) a dispersion in which the organic materials in the form of fine particles have been dispersed in a solution of the matrix resin or (c) a dispersion in a solvent, in which neither the organic materials nor the matrix resin are dissolved. After such solution or dispersion is disposed onto the substrate, the solvent is removed, and then the graft polymer or copolymer matrix resin is cross-linked by heating, irradiating ultraviolet ray or electron beam hardening monomers and oligomers, to thereby provide a thermosensitive recording layer of a laminate.

As aforementioned, utilizing a non-saturated bond at the end portion of the side chain of the polymerizing unit, the graft polymer or copolymer may take part in cross-linking reactions by heating or irradiating with an ultraviolet ray or electron beam. The cross-linking reactions may be carried out efficiently by adding an appropriate cross-linking initiator, when relevant.

For use in the matrix resin disclosed herein, there may be selected among thermoplastic resins, thermosetting resins, ultraviolet hardening monomers and oligomers, and electron beam hardening monomers and oligomers, which may be appropriately used in combination with the graft polymers.

Referring to FIG. 1, there is shown the change in transparency by heating of a thermosensitive layer including, as main ingredients, a matrix resin and a low molecular weight organic material dispersed in the matrix resin.

The thermosensitive layer is at a white opaque state at an ambient temperature of $T_0$ or below. Upon being heated, the thermosensitive layer at a temperature $T_1$ begins gradually to become transparent and becomes completely transparent in a temperature range of from $T_2$ to $T_3$. When this layer is cooled down to ambient temperature below $T_0$, the layer remains transparent.

On the other hand, when heated to a temperature $T_4$ or higher, the layer becomes translucent, between the maximum transparency and the white opaqueness. When the temperature is subsequently lowered, the layer returns to the original white opaque state rather than the transparent state.

Therefore, the reversible characteristics of the thermosensitive recording layer which includes a matrix resin and a low molecular weight organic material dispersed in the matrix resin, are characterized by a white opaque temperature $T_0$, a transparency initiation temperature $T_1$, the lowest transparent temperature $T_2$, the highest transparent temperature $T_3$ and a translucent temperature $T_4$.

In addition, in order to achieve satisfactory image-forming and erasure properties and durability of these properties, which is one of the major objectives of the present invention, it is necessary to provide recording media in which the relationship between the optical properties and the characteristic temperatures $T_0$, $T_1$, $T_2$, $T_3$ and $T_4$, exhibits none or minimal changes, if any, throughout the imaging processes.

As disclosed herein, improvement has been made in the thermosensitive recording layer which includes a matrix resin and at least one kind of low molecular weight organic material dispersed in the matrix resin. Namely, by utilizing a matrix resin composed of a graft polymer or copolymer, having the aforementioned polymerizing unit of the formulae (I) or (II), and especially by utilizing a cross-linked polymer prepared by cross-linking a graft polymer or copolymer, by heating, by irradiation with an electron beam or by irradiation with an ultraviolet ray, it becomes feasible to provide a recording medium with satisfactory image recording characteristics, in which the relationship between the optical properties and the characteristic temperatures $T_0$, $T_1$, $T_2$, $T_3$ and $T_4$, exhibits none or minimal changes throughout the imaging processes.

The thickness of the reversible recording layer is preferably from 1 to 30 μm, more preferably from 2 to 20 μm. A thickness above the above range causes a difficulty in transparentization throughout the area of the recording layer due to the decrease in thermal sensitivity. By contrast, a thickness below the above range causes a decreased image contrast due to the decrease in the amount of the white opaqueness. Furthermore, this decrease in the white opaqueness may be obviated by increasing the amount of the low molecular weight organic material to be included in the recording layer.

The recording layer may contain, in addition to the above constituent materials, additives such as a plasticizer and a surfactant to facilitate the formation of transparent images.

Examples of useful plasticizers include tributyl phosphate, tri-2-ethylhexyl phosphate, triphenyl phosphate, tricresyl phosphate, butyl oleate, dimethyl phthalate, diethyl phthalate, dibutyl phthalate, dihepthyl phthalate, di-n-octyl phthalate, di-2-ethylhexyl phthalate, diisononyl phthalate, dioctyldecyl phthalate, diisodecyl phthalate, butyl benzyl phthalate, dibutyl adipate, di-n-hexyl adipate, di-2-ethylhexyl adipate, di-2-ethylhexyl azelate, dibutyl sebacate, di-2-ethylhexyl sebacate, diethyl dibenzoate, triethylene glycol di-2-ethylbutylate, methyl acetylricinoleate, butyl acetylricinoleate, and butylphtalyl butyl.

Examples of the surfactant and other additives include higher fatty acid esters of a polyhydric alcohol, higher alkyl ethers of a polyhydric alcohol, a higher alcohol, a higher alkyl phenol, a higher fatty acid higher alkyl amine, a higher fatty acid amide; a fat or lower olefin oxide adducts of polypropylene glycol, acetylene glycol, Na, Ca, Ba or Mg salts of higher alkyl benzenesulfonic acid; a higher fatty acid, aromatic carboxylic acid, a higher fatty acid sulfonic acid, aromatic sulfonic acid, Ba, Ca or Mg salts of sulfuric acid monoester or mono or diester of phosphoric acid; low degree sulfonated oil; poly(long chain alkyl acrylate); acrylic oligomers; poly(long chain alkyl methacrylate); copolymers of long chain alkyl methacrylate with amine-containing monomer; styrene-maleic anhydride copolymers; and olefin-maleic anhydride copolymers.

The reversible thermosensitive recording material disclosed herein is generally prepared by disposing a recording layer onto a supporting substrate such as a plastic film, a glass plate or a metal plate.

The reversible thermosensitive recording medium is provided on the recording layer with an overcoat layer having a rough surface with a number and height of protruded portions of at least 3 and at least 0.05 μm, respectively, for each surface area of 125 μm×125 μm, and having a pencil hardness of at least 2H. Since a commercially available thermal printhead generally has a dot density of 8 dots/mm, this results in each area of 125 μm×125 μm being occupied by a single dot.

By providing the overcoat layer on the recording layer, as described just above, a recording medium can be achieved, which does not give rise to a rough surface with an approximately periodic feature, corresponding to the dot density of the thermal printhead, even after the image forming and erasure processes. In addition, the deterioration of image quality after repeated image forming processes, and the reduction of the thermal sensitivity, which is caused by the cracks, peeling, or dirt accumulated on the printhead, can also be avoided with the recording layer disclosed herein.

Namely, with the overcoat layer provided on the recording layer, having a number and height of protruded portions on its rough surface thereof, of at least 3 and at least 0.05 μm, respectively, for each surface area of 125 μm×125 μm, and having a pencil hardness of at least 1H, the formation of a rough surface with an approximately periodic feature can be obviated. These above-mentioned conditions for the number, height and hardness of the protruded portions are preferably fulfilled simultaneously to prevent the formation of the rough surface feature.

The protruded portions formed on the overcoat layer are useful also to obviate the formation of cracks, peeling on the recording layer, or dirt accumulated on the printhead.

Since the surface contact area between the overcoat layer and a thermal printhead, decreases from the contact area between two flat surfaces, by the protruded portions intervening therebetween, the frictional force at the interface decreases. This prevents the occurrence of the cracks, peeling on the recording layer, or dirt accumulated on the printhead, depending upon the number for a unit area, and the height, of the protruded portions. The number is preferably in the range of from 3 to 900 for each surface area of 125 μm×125 μm.

A number of at most 2 protrusions for each such area causes no desirable effect on the surface area reduction described above, since this situation is close to that of flat surfaces. By contrast, when the number exceeds 901, deterioration of the image quality is caused, due to decreased transparency in the area which otherwise remains transparent and generates a clear background.

It is preferred that the height of the protruded portions be from 0.05 to 1.5 μm. A height of less than 0.05 μm causes no desirable effect in preventing cracks, peeling on the recording layer, or dirt accumulated on the printhead, since this situation is close to that of flat surfaces. By contrast, a height of above 1.5 μm makes the contact area too small between the overcoat layer and a thermal printhead. Thereby, it becomes unfeasible to carry out image forming and erasure processes with ordinary heating energy, due to the reduced heat conduction between the overcoat layer and the thermal printhead.

Regarding the combination of the number and height of the protruded portions, it is generally noted that a fewer number of protruded portions is preferable for a larger height, while a larger number is preferable for a smaller height. In addition, with the overcoat layer provided on the recording layer, having a pencil hardness of at least 1H, the formation of cracks, peeling, or dirt on the printhead, can be prevented. Namely, with the overcoat layer, having a pencil hardness of at least 1H, the recording medium may successfully carry out imaging processes of more than 500 times, since this recording medium with the overcoat layer can be prevented from being deformed or deteriorated by heat and/or pressure applied by the thermal printhead, and the particles of the low molecular weight organic materials are prevented from expanding by the heat application, thereby retaining imaging capabilities.

A hardness of less than 1H for the overcoat layer causes, even after repetition of imaging processes of from several to several tens of times, either the formation of a rough surface with an approximately periodic feature or cracks corresponding to the dot density of the thermal printhead, the occurrence of partial peeling of the overcoat layer on the recording layer, or dirt accumulated on the printhead, to thereby make it unfeasible to carry out image forming and erasure processes, due to the reduced heat conduction between the overcoat layer and the thermal printhead. By contrast, with a hardness of above 9H, the formed images deteriorate (become unclear) after the repetition of imaging processes of from 50 to 300 times, due to peelings off the overcoat layer.

The occurrence of the rough surface or peeling by repeated image formation tends to occur more often with increasing softness, while cracks occurs more often with increasing hardness of the overcoat layer. The hardness of the overcoat layer is therefore preferably from 2H to 8H. In addition, the thickness of the overcoat layer, inclusive of protruded portions, is preferably from 0.1 to 10.0 $\mu$m, and more preferably from 1.0 to 6.0 $\mu$m.

The reversible thermosensitive recording medium is provided thereon with a color printed layer and a protective layer. The color printed layer is formed at least in a portion above the overcoat layer, and the protective layer is formed at least in a portion above the color printed layer. The protective layer may be provided also above the overcoat layer without an underlying portion of the color printed layer. The color printed layer is formed by well known methods such as offset, gravure or screen printing, and the protective layer is formed also by similar well known layer forming methods.

In the reversible thermosensitive recording medium disclosed herein, it is preferred that low melting point and high melting point compounds are used in combination as a low molecular weight organic material to increase the temperature range in which the recording material is in the transparent state. The transparent temperature range is illustrated in FIG. 1 by the lowest transparent temperature $T_2$ and the highest transparent temperature $T_3$. The temperature range becomes widened by using the above mentioned low molecular weight material in combination, and this improves the erasure characteristics even with a thermal printhead, which is one of the objectives of this invention.

The low-melting-point low molecular weight organic compound preferably has a melting point lower than 70° C., whereas the high-melting-point compound preferably has a melting point of at least 135° C. In addition, it is preferred that the difference in the melting point between the low and high melting point compounds be at least 45° C.

The temperature range from $T_2$ to $T_3$ is widened further by using at least one kind of the low molecular weight material mentioned just above, and this also improves the erasure characteristics even with a thermal print head, which is one of the objectives of this invention.

The weight ratio of the low molecular weight organic material to the matrix resin in the recording layer is preferably from 3:1 to 1:3 to achieve excellent image contrast.

A proportion of the resin below the above range causes a difficulty in forming a film in which the low molecular weight organic material is retained in the resin. An amount of the resin above the above range causes a difficulty in achieving the white opaqueness, because the amount of the low molecular weight organic material is small.

Furthermore, in the reversible thermosensitive recording medium disclosed herein, it is preferable for the overcoat layer to have a critical surface tension of at least 20 dyne/cm. With the thus formed overcoat layer disposed on an intermediate layer, there is provided a reversible thermosensitive recording medium, capable of satisfactorily transferring printing ink onto an overcoat layer for use in offset printing or gravure printing, and also resistant against scratch or peeling of printed ink from the surface.

A value of the critical surface tension was determined by (1) measuring contact angles at the surface of the protective layer formed on the recording layer with at least 3 levels of wettability standard solutions (from Wako Pure Chemical Ltd), (2) obtaining a Zisman plot with measured surface tension values against the surface tension value of the respective standard solution and (3) extrapolating the plot to the point of the 0° contact angle.

A value of the critical surface tension below 20 dyne/cm causes partial removal by scratching or sticking to an adhesive tape, of the transferred ink from the protective layer. In addition, a value below 15 dyne/cm causes a decreased ink transfer capability and relatively easy removal of the transferred ink from the protective layer by scratching or sticking to an adhesive tape, and a value below 12 dyne/cm causes a difficulty in transferring the ink.

The reversible thermosensitive recording medium is provided on the ink printed layer further with a protective layer, which has a rough surface with a number and height of protruded portions of at least 3 and at least 0.05 $\mu$m, respectively, for each surface area of 125 $\mu$m×125 $\mu$m, and has a pencil hardness of at least 1H.

By providing the protective layer on the ink printed layer, as described just above, a recording medium can be achieved, which does not give rise to a rough surface with an approximately periodic feature corresponding to the dot density of the thermal printhead, even after the image forming and erasure processes. In addition, the deterioration of image quality after the repeated image forming processes, and the reduction of the thermal sensitivity, which is caused by the cracks, peeling or dirt accumulated on the printhead, can also be avoided with the recording layer disclosed herein.

Namely, with the protective layer provided on the ink printed layer, having a number and height of protruded portions on the rough surface thereof, of at least 3 and at least 0.05 $\mu$m, respectively, for each surface area of 125 $\mu$m×125 $\mu$m, and having a pencil hardness of at least 1H, the formation of a rough surface with an approximately periodic feature can be obviated. These above-mentioned conditions for the number, height and hardness of the protruded portions are preferably fulfilled simultaneously to prevent the formation of the rough surface feature.

The protruded portions formed on the protective layer disposed on the ink printed layer are useful also to obviate the formation of the cracks, peeling on the recording layer, or dirt accumulated on the printhead.

Since the surface contact area in between the protective layer and a thermal printhead, decreases from the contact area between two flat surfaces, by the protruded portions intervening therebetween, the frictional force at the interface decreases. This prevents the occurrence of the cracks, peeling on the recording layer, or dirt accumulated on the printhead, depending upon the number for a unit area, and the height, of the protruded portions. The number is preferably in the range of from 3 to 900 for each surface area of 125 μm×125 μm.

A number of at most 2 causes no desirable effect on the surface area reduction described above, since this situation is close to that of the flat surfaces. By contrast, when the number is above 901, deterioration of the image quality is caused, due to decreased transparency in the area which otherwise remains transparent and generates a clear background.

It is preferred that the height of the protruded portions be from 0.05 to 1.5 μm. A height of less than 0.05 μm causes no desirable effect of preventing cracks, peeling on the recording layer, or dirt accumulated on the printhead, since this situation is close to that of the flat surfaces. By contrast, a height of above 1.5 μm makes the contact area too small between the overcoat layer and a thermal printhead. Thereby, it becomes unfeasible to carry out image forming and erasure processes with ordinary heating energy, due to the reduced heat conduction between the overcoat layer and the thermal printhead.

Regarding the combination of the number and height of the protruded portions, it is generally noted that a fewer number of protruded portions is preferable for a larger height, while a larger number is preferable for a smaller height. In addition, with the protective layer provided on the ink printed layer, having a pencil hardness of at least 1H, the formation of cracks, peeling, or dirt on the printhead, can be prevented. Namely, with the protective layer, having a pencil hardness of at least 2H, the recording medium may successfully carry out imaging processes of more than 500 times, since this recording medium with this protective layer can be prevented from being deformed or deteriorated by heat and/or pressure applied by the thermal printhead, and the particles of the low molecular weight organic materials are prevented from expanding by the heat application, thereby retaining imaging capabilities.

A hardness of less than 1H for the protective layer causes, even after the repetition of imaging processes of from several to several tens of times, either the formation of a rough surface with an approximately periodic feature or cracks corresponding to the dot density of the thermal printhead, the occurrence of partial peeling of the protective layer on the ink printed layer, or dirt accumulated on the printhead, to thereby make it unfeasible to carry out image forming and erasure processes, due to the reduced heat conduction between the overcoat layer and the thermal printhead. By contrast, with a hardness of above 9H, the formed images become unclear after the repetition of imaging processes of 50 to 300 times, due to peelings off on the protective layer.

The rough surface or peeling occurs more often by repeated image formation with increasing softness, while cracks occur more often with increasing hardness of the protective layer. The hardness of the protective layer is therefore preferably from 1H to 8H. In addition, the thickness of the protective layer, inclusive of protruded portions, is preferably from 0.1 to 10.0 μm, and more preferably from 0.5 to 3.0 μm.

When the formed image is observed as a reflection type image, it is preferred that a light reflection layer be provided behind the recording layer. The reflection layer can increase the contrast even when the thickness of the recording layer is relatively thin. Specifically , the reflection layer may be formed by deposition of Al, Ni, Sn or the like metal as disclosed in JPA-64-14079. When the adhesion between the recording layer and the light reflection layer is not satisfactory, there may be provided an adhesive layer therebetween.

Further, an intermediate layer may be interposed between the protective layer and the recording layer to protect the recording layer from the solvent or a monomer component of the protective layer formation liquid (JPA-1-133781). In addition to the resins exemplified as the resin matrix materials for the recording layer, there may be used thermosetting resins, thermoplastic resins, UV-curable monomers and oligomers, and electron beam curable monomers and oligomers, which may be used in combination with the aforementioned graft polymers and copolymers disclosed herein.

In addition to the reversible thermosensitive recording layer, the recording medium may further provided with other information recording sections composed of, for example, a magnetic recording layer, IC memories, optical memories and magneto-optical memories, to thereby provide invisible information as well as visible information.

As the layer construction of the thermosensitive recording medium mentioned above, there may be mentioned a construction in which, as disclosed in Japanese Laid-Open Utility Model Application No. 2-3876 (1990), a thermosensitive recording layer and a magnetic recording layer containing magnetic material as a main ingredient are provided on a supporting substrate, at least the portion immediately below the thermosensitive recording layer or the portion of the substrate corresponding to the thermosensitive recording layer being color-coated.

Alternatively, as disclosed in JPA-3-130188, there may be mentioned a construction in which a supporting substrate is overlaid with a magnetic recording layer, a light reflecting layer and a thermosensitive layer in the order recited. In this case, the magnetic recording layer may be provided either at least at a portion between the supporting substrate and thermosensitive layer, on the backside of the supporting substrate, or on the label surface.

A color printed or color layer may further be provided between the supporting substrate and the recording layer to improve the visibility. The color layer may be formed by applying and drying a solution or a dispersion containing, as main ingredients, a coloring agent and a resin binder or by simply applying a color sheet.

Any coloring agent may be used as long as it permits the recognition of changes between transparency and white opaqueness of the overlying recording layer as a reflected image. Dyes or pigments of various color may be used. The binder resin useful in the color layer may be a thermoplastic, thermosetting or UV-curable resin.

An air layer or air-containing non-adhesion portion may be interposed between the recording layer and the supporting substrate. Since the index of refraction of low-molecular-weight organic materials used as the main ingredient of the recording layer is in the range of from 1.4 to 1.6 and is quite different from that of air (1.0), light is reflected at the interface between the non-adhesion portion and the film on the thermal recording layer side. Therefore, the air layer serves to amplify the white opaqueness of the recording layer in the white opaque or translucent state, thereby improving the visibility. It is therefore desirable to use the non-adhesion portion as a displaying section.

Since the non-adhesion portion, which contains air therewithin, serves also as a heat insulating layer, the heat sensitivity of the recording medium is improved. In addition, the non-adhesion portion serves to function as a cushion; hence the pressure applied to the recording layer by pressing a thermal printhead can decrease, so that the recording layer is prevented from deforming, and the particles of the low molecular weight organic materials are prevented from expanding by the heat application. The durability in repeated use may therefore be improved.

A layer of an adhesive or pressure-sensitive layer may be further provided on the backside of the supporting substrate to form a reversible thermosensitive recording label. A label sheet of this layer may be applied to a body to be mounted such as a vinyl chloride card (i.e., credit card), an IC card, an ID card, a paper, a film, a synthetic paper, a boarding pass, a commuting ticket, an optical disk (i.e., CD-ROM), a floppy disk or a magneto-optical disk. The body to be mounted is not limited to the above specific examples.

The methods of forming and erasing an image disclosed herein may preferably carried out with a reversible thermosensitive image display system provided with various heating means by appropriately controlling the temperature of the reversible thermosensitive recording medium.

There is one image forming system provided with a thermal printhead or a laser device, in which the common heat generating member such as, for example, the printhead head is used as both image forming and image erasing means. In another method, a thermal printhead is used as the image forming means, while one of contact and pressing type means is used as the image erasing means, such as a thermal printhead, a ceramic heater, a hot stamp, a heat roller or a heat block, or one of non-contact type means using hot air or infrared radiation.

Having generally described preferred embodiments, a further understanding can be obtained by reference to certain specific examples which are provided herein for purposes of illustration only and are not intended to be limiting. In the description in the following examples, parts and percentages are by weight unless otherwise indicated.

EXAMPLES

MATERIAL SYNTHESIS 1

The preparation of a graft copolymer disclosed herein was carried out as follows.

A 300-ml three-necked flask, containing 30 grams of dried methyl iso-butyl ketone (MIBK), was fitted with a cooling tubing and a tubing for introducing gaseous nitrogen. Into the thus provided flask, 10 grams of vinyl chloride-vinyl acetate-2-hydroxypropyl acrylate copolymer (with a mole ratio of 90:3:3 and a number average molecular weight of 33,000) was added gradually at room temperature.

The flask and its contents were heated to 60° C. with a continual stirring in an atmosphere of nitrogen to the point at which the added copolymer was dissolved, then cooled approximately to room temperature.

In a 10-ml sample bottle, were placed 0.006 grams of tin di-n-butyl-dilaurate, 1.69 grams of metacryloyl oxyethyl-isocyanate and 2 grams of MIBK. This mixture was added to the copolymer solution prepared as above with stirring in an atmosphere of nitrogen. Further, the sample bottle was rinsed with 3 grams of MIBK, and the resultant rinse solution was also added to the copolymer solution. The thus prepared mixture was heated to 60° C. in an atmosphere of nitrogen, and stirred for 7 hours while maintaining the temperature. The resultant solution was diluted with 20 grams of MIKB, then cooled approximately to room temperature.

The cooled diluted solution was then added dropwise into 2 liters of rigorously stirred hexane, to precipitate reaction product. The white colored products were filtered, rinsed with about 1.5 liter of hexane, and dried at about 40° C. under reduced pressure.

Thus prepared was 10.33 grams of reaction products comprising graft copolymer of the aforementioned formula (I), in which $R^1$ is hydrogen, $R^2$ is —COO—$CH_2$—C(H)($CH_3$)O— with its —COO bonded to the main chain, $R^3$ is —$CH_2CH_3OCO$— with its —$CH_2$ bonded to the main chain, $R^4$ is a methyl group, and $R^5$ is hydrogen.

Example 1

A reversible thermosensitive recording medium was fabricated in accordance with steps and apparatus which follow.

A coating composition for a magnetic layer was first prepared by mixing the following components.

| | |
|---|---|
| $\gamma$-$Fe_2O_3$ | 10 parts |
| Vinyl chloride-vinyl acetate-vinyl alcohol copolymer (VAGH from UCC Inc.) | 10 parts |
| Polyisocyanate (Colonate from Japan Polyurethane Ltd.) | 1.3 parts |
| Methyl ethyl ketone | 40 parts |
| Toluene | 40.7 parts |

The thus prepared coating composition was coated on a supporting substrate composed of transparent polyethylene terephthalate (PET) film having a thickness of about 100 microns with a wire bar and dried with heating to form a magnetic layer having a thickness of about 10 $\mu$m.

Secondly, a mixture of the following compositions was coated on the thus formed magnetic layer with a wire bar, dried with heating and irradiated with UV radiation of 100 mJ/cm$^2$ to form a smooth layer having a thickness of about 1.5 $\mu$m.

| | |
|---|---|
| Acrylic UV hardening resin (UNIDEC C-164 from Dai Nippon Ink Ltd.) | 10 parts |
| Toluene | 4 parts |

Aluminum was then vacuum-deposited on the smooth layer to obtain a reflection layer with a thickness of about 400 Å.

Subsequently, another mixture of the following compositions was coated on the reflection layer with a wire bar, and dried with heating to form an adhesive layer having a thickness of about 10 $\mu$m.

| | |
|---|---|
| Vinyl chloride-vinyl acetate-phosphoric acid ester copolymer (DENKA VINYL #100P from Denki Kagaku Kogyo K.K.) | 10 parts |
| Tetrahydrofuran | 90 parts |

Still another coating composition, for forming a recording layer, was prepared by mixing the following components.

| | |
|---|---|
| Lignoceric acid | 9 parts |
| Graft copolymer synthesized as described in MATERIAL SYNTHESIS 1 | 30 parts |
| 1-Hydroxycyclohexyl phenyl ketone | 0.8 parts |
| Tetrahydrofuran (Kanto Chemical Ltd.) | 180 parts |
| Toluene | 60 parts |

The thus prepared coating composition was coated on the adhesive layer with a wire bar, dried with heating and irradiated with UV radiation of 200 mJ/cm$^2$ to form a recording layer having a thickness of about 10 $\mu$m.

Subsequently, a mixture of the following compositions was prepared to form an overcoat layer.

| | |
|---|---|
| Urethane acrylate UV hardening resin (Bs 575CS-B from Arakawa Chemical K.K.) | 100 parts |
| 1-Hydroxycyclohexyl phenyl ketone | 2 parts |
| Isopropanol | 200 parts |

The mixture was coated on the recording layer with a wire bar, dried at 90° C. for 2 minutes and irradiated with UV radiation of 450 mJ/cm$^2$, whereby a reversible thermosensitive recording medium was fabricated.

Example 2

A reversible thermosensitive recording medium was fabricated in a similar manner to Example 1, with the exception that the following mixture was used as a coating composition for forming the recording layer.

| | |
|---|---|
| Behenic acid | 4.5 parts |
| Lignoceric acid | 4.5 parts |
| Graft copolymer synthesized as described in MATERIAL SYNTHESIS 1 | 30 parts |
| Neopetyl glycol diacrylate | 6 parts |
| 1-Hydroxycyclohexyl phenyl ketone | 1 parts |
| Tetrahydrofuran (Kanto Chemical Co.) | 200 parts |
| Toluene | 40 parts |

Example 3

A reversible thermosensitive recording medium was fabricated in a similar manner to Example 1, with the exception that the following mixture was used as a coating composition for forming the recording layer.

| | |
|---|---|
| Eicosanedioic acid | 6 parts |
| Lignoceric acid | 3 parts |
| Graft copolymer synthesized as described in MATERIAL SYNTHESIS 1 | 30 parts |
| Neopetyl glycol di-acrylate | 6 parts |
| 1-Hydroxycyclohexyl phenyl ketone | 0.8 parts |
| Tetrahydrofuran (Kanto Chemical Co.) | 180 parts |
| Toluene | 60 parts |

Example 4

A reversible thermosensitive recording medium was fabricated in a similar manner to Example 1, with the exception that the following mixture was used as a coating composition for forming the recording layer.

| | |
|---|---|
| Eicosanedioic acid | 6 parts |
| Behenic acid | 3 parts |
| Graft copolymer synthesized as described in MATERIAL SYNTHESIS 1 | 30 parts |
| Neopetyl glycol diacrylate | 6 parts |
| 1-Hydroxycyclohexyl phenyl ketone | 0.8 parts |
| Tetrahydrofuran (Kanto Chemical Co) | 180 parts |
| Toluene | 60 parts |

Example 5

A reversible thermosensitive recording medium was fabricated in a similar manner to Example 1, with the exception that the following mixture was used as a coating composition, which was coated with a wire bar and dried at 135° C. for 3 minutes, to form the recording layer, having a thickness of about 10 $\mu$m.

| | |
|---|---|
| Eicosanedioic acid | 3 parts |
| Behenic acid | 3 parts |
| Lignoceric acid | 3 parts |
| Graft copolymer synthesized as described in MATERIAL SYNTHESIS 1 | 30 parts |
| 1,1-Bis (tert-butylperoxy)cyclohexane | 1.5 parts |
| Tetrahydrofuran | 180 parts |
| Toluene | 60 parts |

Example 6

A reversible thermosensitive recording medium was fabricated in a similar manner to Example 5, with the exception that a mixture of the following components was used for forming the protective layer.

| | |
|---|---|
| Dipenta-erythritol hexa-acrylate (AYARAD DPHA from Nihon Kayaku K.K.) | 20 parts |
| Hydroxypyruvic ester neopentyl glycol diacrylate (AYARAD MANDA from Nihon Kayaku K.K.) | 80 parts |
| 1-Hydroxycyclohexyl phenyl ketone | 5 parts |
| Butyl acetate | 105 parts |

The mixture was then coated on the recording layer with a wire bar, dried at 90° C. for 1 minute and irradiated with UV radiation of 800 mJ/cm$^2$ to form a protective layer having a thickness of about 5 $\mu$m, whereby a reversible thermosensitive recording medium was fabricated.

The thus formed protective layer was subjected to surface tension measurements, in which contact angles were measured at 25° C. using wettability standard solutions of 46, 50 and 54 dyne/cm (from Wako Pure Chemical Ltd.). A Zisman plot was then obtained with measured surface tension values against the surface tension value of the respective standard solution, to thereby find a critical surface tension of 22 dyne/cm for the above prepared protective layer.

Example 7

A reversible thermosensitive recording medium was fabricated in a similar manner to Example 5, with the exception that a mixture of the following components was used for forming the overcoat layer.

| | |
|---|---|
| Urethane acrylate UV hardening resin (Bs 575CS-B from Arakawa Chemical K.K.) | 100 parts |
| Calcium carbonate (Brilliant-15 from Arakawa Chemical K.K.) | 0.8 parts |
| 1-Hydroxycyclohexyl phenyl ketone | 2 parts |
| Isopropanol | 200 parts |

The thickness of the thus formed overcoat layer was found about 5 $\mu$m inclusive of protruded portions on the surface thereof. The pencil hardness thereof was found to be 4H. In addition, the number and the height of the protruded portions were respectively from 11 to 50 and from 0.51 to 1.5 $\mu$m for each surface area of 125 $\mu$m×125 $\mu$m.

Example 8

A reversible thermosensitive recording medium was fabricated in a similar manner to Example 5, with the exception that (1) a color printed layer having a thickness of about 3 to 8 μm was formed on parts of the overcoat layer by the YMC (yellow-magenta-cyan) color offset printing method using the following components: polyester resin 10 parts, a mixture of oligomers and monomers of acrylic ester 35 parts, photo-polymerization initiator 8 parts, dye pigment 45 parts, and wax 2 parts and (2) a protective layer for the printed layer was formed thereon, having a thickness of about 3 μm, by coating a mixture of the following components with a wire bar, drying at 90° C. for 2 minutes, and irradiating with UV radiation of 450 mJ/cm$^2$, whereby a resultant reversible thermosensitive recording medium was fabricated.

| | |
|---|---|
| Urethane acrylate UV hardening resin (Bs 575CS-B from Arakawa Chemical K.K.) | 100 parts |
| Silicon dioxide (P-526U from Mizusawa Chemical K.K.) | 1.3 parts |
| 1-Hydroxycyclohexyl phenyl ketone | 2 parts |
| Isopropanol | 200 parts |

The pencil hardness of the thus formed protective layer was found to be 4H. In addition, the number and the height of the protruded portions were respectively from 51 to 100 and from 0.1 to 0.5 μm for each surface area of 125 μm×125 μm.

Comparative Example 1

A reversible thermosensitive recording medium was fabricated in a similar manner to Example 1, with the exception that the following mixture was used as a coating composition for forming the recording layer.

| | |
|---|---|
| Eicosanedioic acid | 7.5 parts |
| Behenic acid | 4.5 parts |
| Vinylchloride-vinyl acetate copolymer | 30 parts |
| Neopetyl glycol di-acrylate | 6 parts |
| 1-Hydroxycyclohexyl phenyl ketone | 0.8 parts |
| Tetrahydrofuran (Kanto Chemical Co.) | 180 parts |
| Toluene | 60 parts |

Comparative Example 2

A reversible thermosensitive recording medium was fabricated in a similar manner to Comparative Example 1, with the exception that a mixture of the following components was used for forming the overcoat layer.

| | |
|---|---|
| Trimethylolpropane triacrylate | 20 parts |
| Penta-erythritol tetra-acrylate | 20 parts |
| Ethylene oxide denatured penta-erythritol tetra-acrylate | 40 parts |
| Cyloxane-1,2-dicarboxylic acid-2-hydroxypropanol diester | 15 parts |
| 1-Hydroxycyclohexyl phenyl ketone | 5 parts |

The mixture was then coated on the recording layer with a wire bar, dried at 90° C. for 1 minute and irradiated with UV radiation of 800 mJ/cm$^2$ to form a protective layer having a thickness of about 5 μm, whereby a reversible thermosensitive recording medium was fabricated.

The thus formed protective layer was subjected to surface tension measurements, in which contact angles were measured at 25° C. using wettability standard solutions of 46, 50 and 54 dyne/cm (from Wako Pure Chemical Ltd). A Zisman plot was then obtained with measured surface tension values against the surface tension value of the respective standard solution, to thereby find a critical surface tension of 11 dyne/cm for the above prepared protective layer.

Comparative Example 3

A reversible thermosensitive recording medium was fabricated in a similar manner to Comparative Example 1, with the exception that a mixture of the following components was used for forming the overcoat layer.

| | |
|---|---|
| Polyester UV hardening resin (Bs 550B from Arakawa Chemical K.K.) | 100 parts |
| Calcium carbonate (Brilliant-15 from Arakawa Chemical K.K.) | 0.8 parts |
| Isopropanol | 100 parts |

The thus prepared dispersed solution was coated on the recording layer with a wire bar, dried at 90° C. for 2 minutes and irradiated with UV radiation of 450 mJ/cm$^2$ to form an overcoat layer, whereby a reversible thermosensitive recording medium was fabricated.

The thickness of the thus formed overcoat layer was found to be about 4 μm, including protruded portions on the surface thereof. The pencil hardness thereof was also found to be F. In addition, the number and the height of the protruded portions were respectively from 11 to 50 and from 0.51 to 1.5 μm for each surface area of 125 μm×125 μm.

Example 10

A plurality of reversible thermosensitive recording media fabricated in Examples 1 through 8 and Comparative Example 1 were subjected to several tests as follows, using an image formation/erasure apparatus manufactured by OKI Electronics Ltd.

On these recording media, checkered images were formed with a printing energy of 0.26 mJ/dot, subsequently erased at 105° C.; the formation and erasure processes were repeated 500 times. Optical density values were measured at the same portion of the media, before and after the repetition of these processes, at the white opaque state and transparent state, to find an imaged (white opaque) density and erased (transparent) density, respectively. The durability in repeated imaging processes was then represented by the difference between obtained density values before and after the repetition.

In addition, the erasure durability in a prolonged storage was examined by the image formation/erasure apparatus by (1) measuring optical density in the erased state after erasing at 105° C., (2) forming checkered images with a printing energy of 0.26 mJ/dot, (3) storing for 1 week at 50° C. and (4) obtaining optical density values at the same portion of the media after the erasure. The erasure durability in a prolonged storage was then represented by the difference between the obtained density values before and after the storage.

Furthermore, the durability of formed images against storage at elevated temperatures was examined with the image formation/erasure apparatus by measuring optical density in the white opaque state after the formation of checkered images with a printing energy of 0.26 mJ/dot, storing for 24 hours at 70° C. and then obtaining optical density values at the same portion of the media after the storage. The durability of formed images in the storage at elevated temperatures was then represented by the difference between the obtained density values before and after the storage.

These optical density measurements were carried out with a MacBeth Optical Densitometer. Results from the measurements are summarized shown in Table 1.

TABLE 1

| | Initial optical density | | Change in optical density after 500 cycles | | Change in optical density af- | Change in optical density after |
|---|---|---|---|---|---|---|
| | image formed | image erased | image formed | image erased | ter 1 week at 50° C. | 24 hours at 70° C. |
| Ex. 1 | 0.30 | 1.05 | +0.06 | −0.14 | +0.05 | +0.13 |
| Ex. 2 | 0.30 | 1.09 | +0.07 | −0.15 | +0.05 | +0.11 |
| Ex. 3 | 0.32 | 1.07 | +0.06 | −0.13 | +0.04 | +0.11 |
| Ex. 4 | 0.30 | 1.07 | +0.07 | −0.13 | +0.05 | +0.13 |
| Ex. 5 | 0.29 | 1.10 | +0.04 | −0.11 | +0.04 | +0.09 |
| Ex. 6 | 0.29 | 1.10 | +0.04 | −0.11 | +0.04 | +0.09 |
| Ex. 7 | 0.29 | 1.10 | +0.04 | −0.11 | +0.04 | +0.09 |
| Ex. 8 | 0.29 | 1.10 | +0.04 | −0.11 | +0.04 | +0.09 |
| Comp. Ex. 1 | 0.28 | 1.10 | +0.19 | +0.23 | +0.20 | +0.30 |

Example 11

A plurality of reversible thermosensitive recording media fabricated in Examples 7 and 8 and Comparative Example 3 were visually observed after every 100th imaging process. During the observations of the surfaces of the overcoat or protective layer of these recording media, there was examined whether any change or increase was found, regarding (1) the aforementioned rough surface having an approximately periodic feature corresponding to the dot density of the thermal printhead, (2) cracks and peeling on the recording layer and (3) dirt accumulated on the printhead.

The results from the observations are summarized in Table 2 under the following notations.

Periodic feature appeared on the surface;

A: none, B: only few, and C: clearly observed.

Cracks or peelings appeared;

G: none, and NG: observed.

Dirt accumulated on printhead;

G: none, and NG: observed.

TABLE 2

| | Number of protruded portions | Height of protruded portions | Pencil hardness | Periodically rugged surface 100 | 200 | 300 | 400 | 500 |
|---|---|---|---|---|---|---|---|---|
| Ex. 7 | 11~50 | 0.15~1.50 | 4H | A | A | A | A | A |
| Ex. 8 | 51~100 | 0.11~0.50 | 4H | A | A | A | A | A |
| Comp. Ex. 1 | 0 | 0.51~1.50 | F | B | B | C | C | C |

| | Cracks | | | | | Peeling | | | | | Dirt on thermal print head | | | | |
|---|---|---|---|---|---|---|---|---|---|---|---|---|---|---|---|
| | 100 | 200 | 300 | 400 | 500 | 100 | 200 | 300 | 400 | 500 | 100 | 200 | 300 | 400 | 500 |
| Ex. 7 | G | G | G | G | G | G | G | G | G | G | G | G | G | G | G |
| Ex. 8 | G | G | G | G | G | G | G | G | G | G | G | G | G | G | G |
| Comp. Ex. 1 | G | G | G | G | G | G | G | G | G | G | G | G | G | G | G |

Example 12

A plurality of reversible thermosensitive recording media fabricated in Example 6 and Comparative Example 2 were subjected to several tests regarding printing characteristics thereof. On the surface of the protective layer of each recording media, screen printing was carried out with a white ink. Subsequently, the properties of the surface were examined regarding ink transfer, scratch resistance and anti-peeling property, in which there were determined (1) the ink transfer property by visually observing whether the ink was transferred to the overcoat layer, (2) scratch resistance by observing whether the printed ink was scratched off from the surface with a tip of a pencil and (3) anti-peeling property by observing whether the printed ink was peeled off with an adhesive tape from the surface.

The results from the observations are summarized in Table 3 under the following notations.

Ink transfer property;

○: transferred, and

X: not transferred.

Scratch resistance and anti-peeling property;

○: not peeled off, and

X: peeled off easily.

TABLE 3

| | Critical surface tension (dyne/cm) | Ink transfer property | Scratch resis-tance | Anti-peeling property |
|---|---|---|---|---|
| Ex. 6 | 22 | ○ | ○ | ○ |
| Comp. Ex. 2 | 11 | X | X | X |

MATERIAL SYNTHESIS 2

The preparation of a graft copolymer disclosed herein was carried out as follows.

A 300-ml three-necked flask, containing 30 grams of dried methyl iso-butyl ketone (MIBK), was fitted with a cooling tubing and a tubing for introducing gaseous nitrogen. Into the thus provided flask, 10 grams of vinyl chloride-vinyl acetate-vinyl alcohol copolymer (in proportions of 92:3:5 by weight percent and with a number average molecular weight of 30,000) was added gradually at room temperature.

The flask and its contents were heated to 60° C. with continual stirring in an atmosphere of nitrogen to the point at which the added copolymer was dissolved, then cooled approximately to room temperature.

In a 10-ml sample bottle, were placed 0.005 grams of tin di-n-butyl-dilaurate, 1.69 grams of metacryloyl oxyethyl-isocyanate and 2 grams of MIBK. This mixture was added to the copolymer solution prepared as above with stirring in an atmosphere of nitrogen. Further, the sample bottle was rinsed with 3 grams of MIBK, and the resultant rinse solution was also added to the copolymer solution. The thus prepared mixture was heated to 45° C. in an atmosphere of nitrogen, and stirred for 14 hours while maintaining the temperature. The resultant solution was diluted with 20 grams of MIKB, then cooled approximately to room temperature.

The cooled diluted solution was then added dropwise into 2 liters of rigorously stirred hexane, to precipitate reaction product. The white colored products were filtered, rinsed with about 1.5 liter of hexane, and dried at about 40° C. under reduced pressure.

Thus prepared was 11.32 grams of reaction products comprising graft copolymer of the aforementioned formula (II), in which $R^1$ is hydrogen, $R^2$ is a bond, $R^3$ is —$CH_2CH_3OCO$— with its —$CH_2$ bonded to the main chain, $R^4$ is a methyl group, and $R^5$ is hydrogen.

Example 13

A reversible thermosensitive recording medium was fabricated in accordance with steps and apparatus which follow.

Aluminum was vacuum-deposited on a transparent PET film having a thickness of about 188 microns, to thereby obtain a reflection layer with a thickness of about 400 A. A mixture of the following compositions was subsequently coated on the reflection layer with a wire bar, dried with heating to form an adhesive layer having a thickness of about 1 $\mu$m.

| | |
|---|---|
| Vinyl chloride-vinyl acetate-phosphoric acid ester copolymer (DENKA VINYL #100P from Denki Kagaku Kogyo K.K.) | 10 parts |
| Tetrahydrofuran | 90 parts |

Another coating composition, for forming a recording layer, was prepared by mixing the following components.

| | |
|---|---|
| Lignoceric acid | 9 parts |
| Graft copolymer synthesized as described in MATERIAL SYNTHESIS 2 | 30 parts |
| 1-Hydroxycyclohexyl phenyl ketone | 0.8 parts |
| Tetrahydrofuran (Kanto Chemical Ltd.,) | 180 parts |
| Toluene | 60 parts |

The thus prepared coating composition was coated on the layer adhesive layer with a wire bar, dried with heating and irradiated with UV radiation of 200 mJ/cm$^2$ to form a recording layer having a thickness of about 10 $\mu$m.

Subsequently, a mixture of the following compositions was prepared to form an overcoat layer.

| | |
|---|---|
| Urethane acrylate UV hardening resin (BS 575CS-B from Arakawa Chemical K.K.) | 100 parts |
| 1-Hydroxycyclohexyl phenyl ketone | 2 parts |
| Isopropanol | 200 parts |

The mixture was coated on the recording layer with a wire bar, dried at 90° C. for 2 minutes and irradiated with UV radiation of 450 mJ/cm$^2$, whereby a reversible thermosensitive recording medium was fabricated.

Example 14

A reversible thermosensitive recording medium was fabricated in a similar manner to Example 13, with the exception that the following mixture was used as a coating composition for forming the recording layer.

| | |
|---|---|
| Behenic acid (melting point of approximately 80° C.) | 4.5 parts |
| Lignoceric acid (m.p. approx. 89° C.) | 4.5 parts |
| Graft copolymer synthesized as described in MATERIAL SYNTHESIS 2 | 30 parts |
| Neopetyl glycol diacrylate | 6 parts |
| 1-Hydroxycyclohexyl phenyl ketone | 1 part |
| Tetrahydrofuran (Kanto Chemical Co) | 200 parts |
| Toluene | 40 parts |

Example 15

A reversible thermosensitive recording medium was fabricated in a similar manner to Example 13, with the exception that the following mixture was used as a coating composition for forming the recording layer.

| | |
|---|---|
| Eicosanedioic acid (m.p. approx. 131° C.) | 6 parts |
| Lignoceric acid (m.p. approx. 89° C.) | 3 parts |
| Graft copolymer synthesized as described in MATERIAL SYNTHESIS 2 | 30 parts |
| Neopetyl glycol diacrylate | 6 parts |
| 1-Hydroxycyclohexyl phenyl ketone | 0.8 parts |
| Tetrahydrofuran (Kanto Chemical Co.) | 180 parts |
| Toluene | 60 parts |

Example 16

A reversible thermosensitive recording medium was fabricated in a similar manner to Example 13, with the exception that the following mixture was used as a coating composition for forming the recording layer.

| | |
|---|---|
| Eicosanedioic acid (m.p. approx. 131° C.) | 6 parts |
| Behenic acid (m.p. approx. 80° C.) | 3 parts |
| Graft copolymer synthesized as described in MATERIAL SYNTHESIS 2 | 30 parts |
| Neopetyl glycol diacrylate | 6 parts |
| 1-Hydroxycyclohexyl phenyl ketone | 0.8 parts |
| Tetrahydrofuran (Kanto Chemical Co.) | 180 parts |
| Toluene | 60 parts |

Example 17

A reversible thermosensitive recording medium was fabricated in a similar manner to Example 1, with the exception that the following mixture was used as a coating composition, which was coated with a wire bar, dried at 135° C. for 3 minutes, then aged at 50° C. for 72 hours, to form the recording layer, having a thickness of about 10 μm.

| | |
|---|---|
| Eicosanedioic acid (m.p. approx. 131° C.) | 3 parts |
| Behenic acid (m.p. approx. 80° C.) | 3 parts |
| Lignoceric acid (m.p. approx. 89° C.) | 3 parts |
| Graft copolymer synthesized as described earlier in MATERIAL SYNTHESIS 1 | 30 parts |
| 1,1-Bis(tert-butylperoxy)cyclohexane | 1.5 parts |
| Tetrahydrofuran | 180 parts |
| Toluene | 60 parts |

Example 18

A reversible thermosensitive recording medium was fabricated in a similar manner to Example 17, with the exception that a mixture of the following components was used for forming the protective layer.

| | |
|---|---|
| Dipenta-erythritol hexa-acrylate (AYARAD DPHA from Nihon Kayaku K.K.) | 20 parts |
| Hydroxypyruvic ester neopentyl glycol diacrylate (AYARAD MANDA from Nihon Kayaku K.K.) | 80 parts |
| 1-Hydroxycyclohexyl phenyl ketone | 5 parts |
| Butyl acetate | 105 parts |

The mixture was then coated on the recording layer with a wire bar, dried at 90° C. for 1 minute and irradiated with UV radiation of 800 mJ/cm$^2$ to form a protective layer having a thickness of about 5 μm, whereby a reversible thermosensitive recording medium was fabricated.

The thus formed protective layer was subjected to surface tension measurements, in which contact angles were measured at 25° C. using wettability standard solutions of 46, 50 and 54 dyne/cm (from Wako Pure Chemical Ltd). A Zisman plot was then obtained of measured surface tension values versus the surface tension value of the respective standard solution, to thereby find a critical surface tension of 22 dyne/cm for the above prepared protective layer.

Example 19

A reversible thermosensitive recording medium was fabricated in a similar manner to Example 17, with the exception that a mixture of the following components was used for forming the overcoat layer.

| | |
|---|---|
| Urethane acrylate UV hardening resin (Bs 575CS-B from Arakawa Chemical K.K.) | 100 parts |
| Calcium carbonate (Brilliant-15 from Arakawa Chemical K.K.) | 0.8 parts |
| 1-Hydroxycyclohexyl phenyl ketone | 2 parts |
| Isopropanol | 200 parts |

The thickness of the thus formed overcoat layer was found to be about 5 μm, including protruded portions on the surface thereof. The pencil hardness thereof was found to be 4H. In addition, the number and the height of the protruded portions were respectively from 11 to 50 and from 0.51 to 1.5 μm for each surface area of 125 μm×125 μm.

Example 20

A reversible thermosensitive recording medium was fabricated in a similar manner to Example 17, with the exception that (1) a color printed layer having a thickness of about 3 to 8 μm was formed on the parts of the overcoat layer by the YMC (yellow-magenta-cyan) color offset printing method using the following components: polyester resin 10 parts, a mixture of oligomers and monomers of acrylic ester 35 parts, photo-polymerization initiator 8 parts, dye pigment 45 parts, and wax 2 parts and (2) a protective layer for the printed layer was formed thereon, having a thickness of about 3 μm, by coating a mixture of the following components with a wire bar, drying at 90° C. for 2 minutes, and irradiating with UV radiation of 450 mJ/cm$^2$, whereby a reversible thermosensitive recording medium was fabricated.

| | |
|---|---|
| Urethane acrylate UV hardening resin (Bs 575CS-B from Arakawa Chemical K.K.) | 100 parts |
| Silicon dioxide (P-526U from Mizusawa Chemical K.K.) | 1.3 parts |
| 1-Hydroxycyclohexyl phenyl ketone | 2 parts |
| Isopropanol | 200 parts |

The pencil hardness of the thus formed protective layer was found to be 4H. In addition, the number and the height of the protruded portions were respectively from 51 to 100 and from 0.1 to 0.5 μm for each surface area of 125 μm×125 μm.

Comparative Example 4

A reversible thermosensitive recording medium was fabricated in a similar manner to Example 13, with the exception that the following mixture was used as a coating composition for forming the recording layer.

| | |
|---|---|
| Eicosanedioic acid | 7.5 parts |
| Behenic acid | 4.5 parts |
| Vinylchloride-vinyl acetate copolymer | 30 parts |
| Neopetyl glycol di-acrylate | 6 parts |
| 1-Hydroxycyclohexyl phenyl ketone | 0.8 parts |
| Tetrahydrofuran (Kanto Chemical Co.) | 180 parts |
| Toluene | 60 parts |

Comparative Example 5

A reversible thermosensitive recording medium was fabricated in a similar manner to Comparative Example 4, with the exception that a mixture of the following components was used for forming the overcoat layer.

| | |
|---|---|
| Trimethylolpropane triacrylate | 20 parts |
| Penta-erythritol tetra-acrylate | 20 parts |
| Ethylene oxide denatured penta-erythritol tetra-acrylate | 40 parts |
| Cyloxane-1,2-dicarboxylic acid-2-hydroxypropanol diester | 15 parts |
| 1-Hydroxycyclohexyl phenyl ketone | 5 parts |

The mixture was then coated on the recording layer with a wire bar, dried at 90° C. for 1 minute and irradiated with UV radiation of 800 mJ/cm$^2$ to form a protective layer having a thickness of about 5 μm, whereby a reversible thermosensitive recording medium was fabricated.

The thus formed protective layer was subjected to surface tension measurements, in which contact angles were measured at 25° C. using wettability standard solutions of 46, 50 and 54 dyne/cm (from Wako Pure Chemical Ltd). A Zisman plot was then obtained of measured surface tension values versus the surface tension value of the respective standard solution, to thereby find a critical surface tension of 11 dyne/cm for the above prepared protective layer.

Comparative Example 6

A reversible thermosensitive recording medium was fabricated in a similar manner to Comparative Example 4, with the exception that a mixture of the following components was used for forming the overcoat layer.

| | |
|---|---|
| Polyester UV hardening resin (BS 550B from Arakawa Chemical K.K.) | 100 parts |
| Calcium carbonate (Brilliant-15 from Arakawa Chemical K.K.) | 0.8 parts |
| Isopropanol | 100 parts |

The thus prepared dispersed solution was coated on the recording layer with a wire bar, dried at 90° C. for 2 minutes and irradiated with UV radiation of 450 mJ/cm$^2$ to form an overcoat layer, whereby a reversible thermosensitive recording medium was fabricated.

The thickness of the thus formed overcoat layer was found to be about 4 $\mu$m, including protruded portions on the surface thereof. The pencil hardness thereof was also found to be F. In addition, the number and the height of the protruded portions were respectively from 11 to 50 and from 0.51 to 1.5 $\mu$m for each surface area of 125 $\mu$m×125 $\mu$m.

Example 21

A plurality of reversible thermosensitive recording media fabricated in Examples 13 through 20 and Comparative Example 4 were subjected to several tests as follows, using the image formation/erasure apparatus.

On these recording media, checkered images were formed with a printing energy of 0.26 mJ/dot, subsequently erased at 105° C.; the formation and erasure processes were repeated 500 times. Optical density values were measured at the same portion of the media before and after the repetition of these processes at the white opaque state and transparent state, to find an imaged (white opaque) density and erased (transparent) density, respectively. The durability in repeated imaging processes was then represented by the difference between obtained density values before and after the repetition.

In addition, the erasure durability in a prolonged storage was examined by the image formation/erasure apparatus by (1) measuring optical density at the erased state after erasing at 105° C., (2) forming checkered images with a printing energy of 0.26 mJ/dot, (3) storing for 1 week at 50° C. and (4) obtaining optical density values at the same portion of the media after erasure. The erasure durability in a prolonged storage was then represented by the difference between the obtained density values before and after the storage.

Furthermore, the durability of formed images against storage at elevated temperatures was examined with the image formation/erasure apparatus by measuring optical density in the white opaque state after the formation of checkered images with a printing energy of 0.26 mJ/dot, storing for 24 hours at 70° C. and then obtaining optical density values at the same portion of the media after the storage. The durability of formed images in the storage at elevated temperatures was then represented by the difference between the obtained density values before and after the storage.

These optical density measurements were carried out with a MacBeth Optical Densitometer. Results from the measurements are summarized shown in Table 4.

TABLE 4

| | Initial optical density | | Change in optical density after 500 cycles | | Change in optical density after | Change in optical density after |
|---|---|---|---|---|---|---|
| | image formed | image erased | image formed | image erased | 1 week at 50° C. | 24 hours at 70° C. |
| Ex. 13 | 0.30 | 1.04 | +0.07 | −0.15 | +0.05 | +0.12 |
| Ex. 14 | 0.30 | 1.09 | +0.07 | −0.15 | +0.04 | +0.10 |
| Ex. 15 | 0.31 | 1.08 | +0.06 | −0.12 | +0.04 | +0.11 |
| Ex. 16 | 0.30 | 1.08 | +0.06 | −0.12 | +0.05 | +0.12 |
| Ex. 17 | 0.30 | 1.10 | +0.04 | −0.10 | +0.04 | +0.08 |
| Ex. 18 | 0.30 | 1.10 | +0.04 | −0.10 | +0.04 | +0.08 |
| Ex. 19 | 0.31 | 1.10 | +0.04 | −0.10 | +0.04 | +0.08 |
| Ex. 20 | 0.31 | 1.10 | +0.04 | −0.10 | +0.04 | +0.08 |
| Comp. Ex. 4 | 0.28 | 1.10 | +0.19 | +0.23 | +0.20 | +0.30 |

Example 22

A plurality of reversible thermosensitive recording media fabricated in Examples 19 and 20 and Comparative Example 6 were visually observed after every 100th imaging process. During the observations of the surfaces of the overcoat or protective layer of these recording media, there was examined whether any change or increase was found, regarding (1) the aforementioned rough surface having an approximately periodic feature corresponding to the dot density of the thermal printhead, (2) cracks and peeling on the recording layer and (3) dirt accumulated on the printhead.

The results from the observations are summarized in Table 5.

TABLE 5

| | Number of protruded portions | Height of protruded portions | Pencil hardness | Periodically rugged surface 100 | 200 | 300 | 400 | 500 |
|---|---|---|---|---|---|---|---|---|
| Ex. 18 | 11~50 | 0.15~1.50 | 4H | A | A | A | A | A |
| Ex. 20 | 51~100 | 0.11~0.50 | 4H | A | A | A | A | A |
| Comp. Ex. 6 | 0 | 0.51~1.50 | F | B | B | C | C | C |

TABLE 5-continued

| | Cracks | | | | | Peeling | | | | | Dirt on thermal print head | | | | |
|---|---|---|---|---|---|---|---|---|---|---|---|---|---|---|---|
| | 100 | 200 | 300 | 400 | 500 | 100 | 200 | 300 | 400 | 500 | 100 | 200 | 300 | 400 | 500 |
| Ex. 18 | G | G | G | G | G | G | G | G | G | G | G | G | G | G | G |
| Ex. 20 | G | G | G | G | G | G | G | G | G | G | G | G | G | G | G |
| Comp. Ex. 6 | G | G | G | G | G | G | G | G | G | G | G | G | G | G | G |

Example 23

A plurality of reversible thermosensitive recording media fabricated in Example 18 and Comparative Example 5 were subjected to several tests regarding printing characteristics thereof. In similar manner to Example 12, on the surface of the protective layer of each recording media, a screen printing was carried out with a white ink. Subsequently, the properties of the surface was examined regarding the ink transfer, scratch resistance and anti-peeling property.

The results from the observations are summarized in Table 6, using the symbols defined in Example 12.

TABLE 6

| | Critical surface tension (dyne/cm) | Ink transfer property | Scratch resistance | Anti-peeling property |
|---|---|---|---|---|
| Ex. 18 | 22 | ○ | ○ | ○ |
| Comp. Ex. 5 | 11 | X | X | X |

As will be apparent from the above description including the examples, the reversible thermosensitive recording medium disclosed herein is capable of satisfactorily carrying out the erasure of recorded images with a heating device such as, for example, a thermal printhead, by overcoming difficulties such as the reduction of erasability after storage of recorded white opaque images for a long time and/or at elevated storage temperatures, the deterioration of image quality after repeated imaging processes which is caused by portions of the recording layer becoming adhered to a heating element and by a rough feature of the surface of the recording layer, and an insufficient transfer capability of printing ink onto an overcoat layer for use in offset printing and gravure printing, to thereby achieve a sufficient contrast of recorded images and ink transfer capability of reversible thermosensitive recording media.

This document claims priority and contains subject matter related to Japanese Patent Application 10-30366 (1998), filed with the Japanese Patent Office on Jan. 29, 1998, the entire contents of which are hereby incorporated by reference.

Additional modifications and variations of the embodiments disclosed herein are possible in light of the above teachings. It is therefore to be understood that within the scope of the appended claims, these embodiments may be practiced otherwise than as specifically described herein.

What is claimed is:

1. A reversible thermosensitive composition, comprising a matrix resin and at least one low molecular weight organic material dispersed in said matrix resin, said reversible thermosensitive composition changing transparency reversibly with temperature, wherein said matrix resin comprises a graft polymer or a graft copolymer, having a polymerizing unit of the formula (I):

(I)

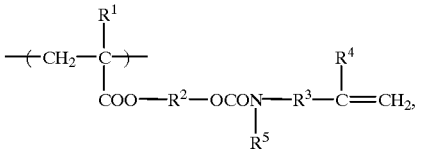

wherein $R^1$ and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen, or $—CON(R^5)—R^3—C(R^4)=(CH_2)$, inclusive of hydrogen at the end of a polymer chain.

2. A reversible thermosensitive recording medium comprising a reversible thermosensitive recording layer comprising a composition according to claim 1, and further comprising an overcoat layer that is provided on said reversible thermosensitive recording layer, said overcoat layer having a rough surface with a number and height of protruded portions of at least 3 and at least 0.05 μm, respectively, for each surface area of 125 μm×125 μm, and having a pencil hardness of at least 1H.

3. A reversible thermosensitive recording medium according to claim 2, wherein said overcoat layer has a critical surface tension of at least 20 dyne/cm.

4. A reversible thermosensitive recording medium according to claim 2, further comprising a supporting substrate and a color printed layer that is formed from a coloring agent and a resin binder and provided at least in a portion either above said overcoat layer or on a side of said supporting substrate opposite to said recording layer.

5. A reversible thermosensitive recording medium according to claim 4, further comprising a protective layer that is provided on said color printed layer.

6. A reversible thermosensitive recording medium according to claim 5, wherein said protective layer on said color printed layer has a rough surface with a number and height of protruded portions of at least 3 and at least 0.05 μm, respectively, for each surface area of 125 μm×125 μm, and has a pencil hardness of at least 1H.

7. A reversible thermosensitive recording medium according to claim 2, wherein said overcoat layer comprises two kinds of compositional layers.

8. A reversible thermosensitive composition according to claim 1, wherein said low molecular weight organic material is a mixture of at least one low melting point low molecular weight organic compound and at least one high melting point low molecular weight organic compound, the difference in melting point between the low melting point and high melting point being at least 45° C.

9. A reversible thermosensitive composition according to claim 1, wherein the ratio by weight of said low molecular weight organic material to said matrix resin is in the range of from 3:1 to 1:3.

10. A method of forming and erasing an image on a reversible thermosensitive recording medium having a recording layer comprising a composition as defined in claim 1, wherein the formation of a white opaque image and the erasure of the white opaque image is carried out by heating.

11. A method of forming and erasing an image on a reversible thermosensitive recording medium according to claim 10, wherein said heating is carried out with a thermal printhead.

12. A method of forming and erasing an image on a reversible thermosensitive recording medium according to claim 10, wherein said heating is carried out with at least one the heating means selected from the group essentially consisting of a thermal printhead, a ceramic heater, a hot stamp, a heat roller and a heat block.

13. A reversible thermosensitive composition, comprising a matrix resin and at least one low molecular weight organic material dispersed in said matrix resin, said reversible thermosensitive composition changing transparency reversibly with temperature, wherein said matrix resin comprises a graft polymer or a graft copolymer, having a polymerizing unit of the formula (II), (II)

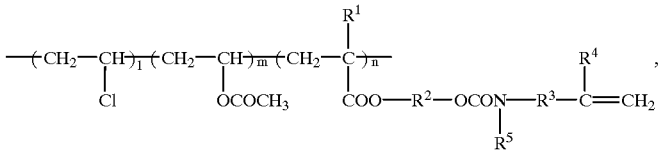

wherein $R^1$ and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen, or $—CON(R^5)—R^3—C(R^4)=(CH_2)$, inclusive of hydrogen at the end of a polymer chain; l, m and n each is an integer of at least one, that is selected such that the number average molecular weight of said copolymer is at least 1000.

14. A reversible thermosensitive recording medium comprising a reversible thermosensitive recording layer comprising a composition according to claim 13, and further comprising an overcoat layer that is provided on said reversible thermosensitive recording layer, said overcoat layer having a rough surface with a number and height of protruded portions of at least 3 and at least 0.05 μm, respectively, for each surface area of 125 μm×125 μm, and having a pencil hardness of at least 1H.

15. A reversible thermosensitive recording medium according to claim 14, wherein said overcoat layer has a critical surface tension of at least 20 dyne/cm.

16. A reversible thermosensitive recording medium according to claim 14, further comprising a supporting substrate and a color printed layer that is formed from a coloring agent and a resin binder and provided at least in a portion either above said overcoat layer or on a side of said supporting substrate opposite to said recording layer.

17. A reversible thermosensitive recording medium according to claim 14, further comprising a protective layer that is provided on said color printed layer.

18. A reversible thermosensitive recording medium according to claim 17, wherein said protective layer on said color printed layer has a rough surface with a number and height of protruded portions of at least 3 and at least 0.05 μm, respectively, for each surface area of 125 μm×125 μm, and has a pencil hardness of at least 1H.

19. A reversible thermosensitive recording medium according to claim 14, wherein said overcoat layer comprises two kinds of compositional layers.

20. A reversible thermosensitive composition according to claim 13, wherein said low molecular weight organic material is a mixture of at least one low melting point low molecular weight organic compound and at least one high melting point low molecular weight organic compound, the difference in melting point between the low melting point and high melting point being at least 45° C.

21. A reversible thermosensitive composition according to claim 13, wherein the ratio by weight of said low molecular weight organic materials to said matrix resin is in the range of from 3:1 to 1:3.

22. A method of forming and erasing an image on a reversible thermosensitive recording medium having a recording layer comprising a composition as defined in claim 13, wherein the formation of a white opaque image and the erasure of the white opaque image is carried out by heating.

23. A method of forming and erasing an image on a reversible thermosensitive recording medium according to claim 22, wherein said heating is carried out with a thermal printhead.

24. A method of forming and erasing an image on a reversible thermosensitive recording medium according to claim 22, wherein said heating is carried out with at least one the heating means selected from the group essentially consisting of a thermal printhead, a ceramic heater, a hot stamp, a heat roller and a heat block.

25. A reversible thermosensitive recording medium, comprising a supporting substrate and a reversible thermosensitive recording layer disposed at least on a portion of said supporting substrate and including, as main ingredients, a matrix resin and a low molecular weight organic material dispersed in said matrix resin, said reversible thermosensitive recording layer changing transparency reversibly with temperature, wherein said matrix resin comprises a graft polymer or a graft copolymer, having a plurality of polymerizing units of the formulae (I) and (II):

(I)

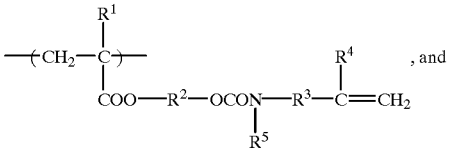

, and (II)

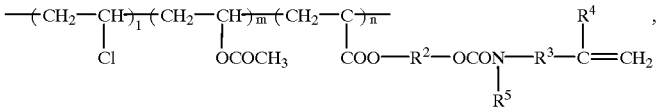

wherein $R^1$ and $R^4$ each is hydrogen or an alkyl group; $R^2$ is a bond, a dibasic fatty acid group, a divalent aromatic group, or a divalent group of admixed fatty acid and aromatic group, divalent group of admixed fatty acid and aromatic groups; $R^3$ is a dibasic fatty acid group, a divalent aromatic group, or a divalent group of admixed fatty acid and aromatic groups; and $R^5$ is hydrogen, or —CON($R^5$)—$R^3$—C($R^4$)=($CH_2$), inclusive of hydrogen at the end of a polymer chain; l, m and n each is an integer of at least one, that is selected such that the number average molecular weight of said copolymer is at least 1000.

26. A reversible thermosensitive recording medium according to claim 25, further comprising an overcoat layer that is provided on said reversible thermosensitive recording layer, said overcoat layer having a rough surface with a number and height of protruded portions of at least 3 and at least 0.05 μm, respectively, for each surface area of 125 μm×125 μm, and having a pencil hardness of at least 1H.

27. A reversible thermosensitive recording medium according to claim 26, wherein said overcoat layer has a critical surface tension of at least 20 dyne/cm.

28. A reversible thermosensitive recording medium according to claim 26, further comprising a color printed layer that is formed from a coloring agent and a resin binder and provided at least in a portion either above said overcoat layer or on a side of said supporting substrate opposite to said recording layer.

29. A reversible thermosensitive recording medium according to claim 26, further comprising a protective layer that is provided on said color printed layer.

30. A reversible thermosensitive recording medium according to claim 29, wherein said protective layer on said color printed layer has a rough surface with a number and height of protruded portions of at least 3 and at least 0.05 μm, respectively, for each surface area of 125 μm×125 μm, and has a pencil hardness of at least 1H.

31. A reversible thermosensitive recording medium according to claim 26, wherein said overcoat layer comprises two kinds of compositional layers.

32. A reversible thermosensitive recording medium according to claim 25, wherein said low molecular weight organic material is a mixture of at least one low melting point low molecular weight organic compound and at least one high melting point low molecular weight organic compound, the difference in melting point between the low melting point and high melting point being at least 45° C.

33. A reversible thermosensitive recording medium according to claim 25, wherein the ratio by weight of said low molecular weight organic material to said matrix resin is in the range of from 3:1 to 1:3.

34. A reversible thermosensitive recording medium according to claim 25, further comprising an information recording section.

35. A reversible thermosensitive recording medium according to claim 34, wherein said information recording section comprises a magnetic layer that is provided either on a supporting substrate, at least in a portion immediately below said thermosensitive recording layer; at least in a portion of a side of said supporting substrate opposite said thermosensitive recording layer; or on a label surface.

36. A reversible thermosensitive recording medium according to claim 34, wherein said information recording section comprises IC memories or optical memories, that is provided at least in a portion of said reversible thermosensitive recording medium.

37. A reversible thermosensitive recording medium according to claim 36, wherein said reversible thermosensitive recording medium comprises two kinds of compositional substrates that are laminated to each other.

38. A reversible thermosensitive recording medium according to claim 25, wherein said reversible thermosensitive recording medium comprises two kinds of compositional substrates that are laminated to each other.

39. A reversible thermosensitive recording medium according to claim 25, further comprising a color printed layer that is formed from a coloring agent and a resin binder and provided at least in a portion either above said overcoat layer or on a side of said supporting substrate opposite to said thermosensitive recording layer.

40. A method of forming and erasing an image on a reversible thermosensitive recording medium as defined in claim 25, wherein the formation of a white opaque image and the erasure of the white opaque image is carried out by heating.

41. A method of forming and erasing an image on a reversible thermosensitive recording medium according to claim 40, wherein said heating is carried out with a thermal printhead.

42. A method of forming and erasing an image on a reversible thermosensitive recording medium according to claim 40, wherein said heating is carried out with at least one the heating means selected from the group essentially consisting of a thermal printhead, a ceramic heater, a hot stamp, a heat roller and a heat block.

43. A reversible thermosensitive recording medium, comprising a supporting substrate and a reversible thermosensitive recording layer disposed at least on a portion of said supporting substrate and including, as main ingredients, a matrix resin and a low molecular weight organic material dispersed in said matrix resin, said reversible thermosensitive recording layer changing transparency reversibly with temperature, wherein said matrix resin comprises a cross-linked polymer prepared by cross-linking a graft polymer or a graft copolymer, by heating, by irradiation with an electron beam or by irradiation with an ultraviolet ray, said graft polymer or a graft copolymer having a plurality of polymerizing units of the formulae (I) and (II):

(I)

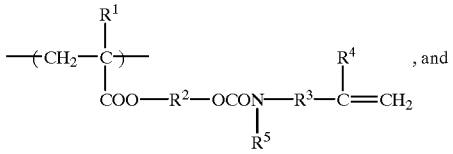

, and (II)

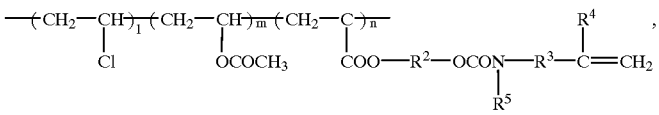

, wherein $R^1$ and $R^4$ each is hydrogen or an alkyl group; $R^2$ is a bond, a dibasic fatty acid group, a divalent aromatic group, or a divalent group of admixed fatty acid and aromatic groups; $R^3$ is a dibasic fatty acid group, a divalent aromatic group, or a divalent group of admixed fatty acid and aromatic groups; and $R^5$ is hydrogen, or $—CON(R^5)—R^3—C(R^4)=(CH_2)$, inclusive of hydrogen at the end of a polymer chain; l, m and n each is an integer of at least one, that is selected such that the number average molecular weight of said copolymer is at least 1000.

44. A reversible thermosensitive recording medium according to claim 43, further comprising an overcoat layer that is provided on said reversible thermosensitive recording layer, said overcoat layer having a rough surface with a number and height of protruded portions of at least 3 and at least 0.05 μm, respectively, for each surface area of 125 μm×125 μm, and having a pencil hardness of at least 1H.

45. A reversible thermosensitive recording medium according to claim 44, wherein said overcoat layer has a critical surface tension of at least 20 dyne/cm.

46. A reversible thermosensitive recording medium according to claim 44, further comprising a color printed layer that is formed from a coloring agent and a resin binder and provided at least in a portion either above said overcoat layer or on a side of said supporting substrate opposite to said recording layer.

47. A reversible thermosensitive recording medium according to claim 44, further comprising a protective layer that is provided on said color printed layer.

48. A reversible thermosensitive recording medium according to claim 47, wherein said protective layer on said color printed layer has a rough surface with a number and the height of protruded portions of at least 3 and at least 0.05 μm, respectively, for each surface area of 125 μm×125 μm, and has a pencil hardness of at least 1H.

49. A reversible thermosensitive recording medium according to claim 44, wherein said overcoat layer comprises two kinds of compositional layers.

50. A reversible thermosensitive recording medium according to claim 43, wherein said low molecular weight organic material is a mixture of at least one low melting point low molecular weight organic compound and at least one high melting point low molecular weight organic compound, the difference in melting point between the low melting point and high melting point being at least 45° C.

51. A reversible thermosensitive recording medium according to claim 43, wherein the ratio by weight of said low molecular weight organic material to said matrix resin is in the range of from 3:1 to 1:3.

52. A reversible thermosensitive recording medium according to claim 43, further comprising an information recording section.

53. A reversible thermosensitive recording medium according to claim 52, wherein said information recording section comprises a magnetic layer that is provided either on a supporting substrate, at least in a portion immediately below said thermosensitive recording layer; at least in a portion of a side of said supporting substrate opposite said thermosensitive recording layer; or on a label surface.

54. A reversible thermosensitive recording medium according to claim 52, wherein said information recording section comprises IC memories or optical memories, that is provided at least in a portion of said reversible thermosensitive recording medium.

55. The reversible thermosensitive recording medium according to claim 54, wherein said reversible thermosensitive recording medium comprises two kinds of compositional substrates that are laminated to each other.

56. A reversible thermosensitive recording medium according to claim 43, wherein said reversible thermosensitive recording medium comprises two kinds of compositional substrates that are laminated to each other.

57. A reversible thermosensitive recording medium according to claim 43, further comprising a color printed layer that is formed from a coloring agent and a resin binder and provided at least in a portion either above said overcoat layer or on a side of said supporting substrate opposite to said thermosensitive recording layer.

58. A method of forming and erasing an image on a reversible thermosensitive recording medium as defined in claim 43, wherein the formation of a white opaque image and the erasure of the white opaque image is carried out by heating.

59. The method of forming and erasing an image on a reversible thermosensitive recording medium according to claim 58, wherein said heating is carried out with a thermal printhead.

60. The method of forming and erasing an image on a reversible thermosensitive recording medium according to claim 58, wherein said heating is carried out with at least one the heating means selected from the group essentially consisting of a thermal printhead, a ceramic heater, a hot stamp, a heat roller and a heat block.

* * * * *